United States Patent [19]

Auerbach

[11] Patent Number: 4,958,737

[45] Date of Patent: Sep. 25, 1990

[54] CRT OR COMPUTER MONITOR ACCESSORY TRAY

[76] Inventor: Abraham E. Auerbach, HCR 2648, Oracle, Ariz. 85623

[21] Appl. No.: 467,008

[22] Filed: Jan. 18, 1990

[51] Int. Cl.[5] ..... A47F 5/12; A47F 7/00

[52] U.S. Cl. ..... 206/557; 248/148; 211/126; 206/214

[58] Field of Search ..... 108/1, 43, 44, 45, 90; 248/148, 918, 206.5; 211/45, 50, 126; 206/557, 565, 214

[56] References Cited

U.S. PATENT DOCUMENTS

| | | | |
|---|---|---|---|
| 3,595,513 | 7/1971 | Rehlaender | 248/148 X |
| 4,444,319 | 4/1984 | Sharber | 211/50 |
| 4,570,804 | 2/1986 | Meenan | 211/126 |
| 4,735,467 | 4/1988 | Wolters | 248/918 X |
| 4,844,264 | 7/1989 | Deskiewicz, Jr. | 211/50 |
| 4,846,382 | 7/1989 | Foultner et al. | 108/45 X |

OTHER PUBLICATIONS

See attached copy of catalog page, showing molded plastic tray, catalog from American Computer Supply, 2828 Forest Lane, Dallas, TX., 75234.

*Primary Examiner*—Paul T. Sewell
*Assistant Examiner*—Jacob K. Ackun, Jr.

[57] ABSTRACT

An accessory tray which can be placed atop a computer monitor regardless of the monitor's size and shape. The underside of the tray has a rubber friction pad attached near its front, and a bendable wire attached near its rear by means of tubes welded to the underside. The wire is bent to hold the rear of the tray spaced from the top of the monitor so that the tray will not block any air vents in the top of the monitor. The friction pad, and a soft plastic sleeve over the portion of the wire that contacts the top of the monitor, enable the tray to resist slipping. Options such as a copyholder and a static electricity grounding connection are also attachable to the underside of the tray.

20 Claims, 7 Drawing Sheets

CRT OR COMPUTER MONITOR ACCESSORY TRAY

BACKGROUND

1. Field of Invention

This invention relates to computer or other CRT monitors, specifically to a tray or shelf which can be mounted on such a monitor.

BACKGROUND

2. Description of Prior Art

Heretofore the office worker who acquired a desktop computer sacrificed much desk work space. Additional desk space was often lost to the computer "mouse" which demanded its own space, whether used or not. (Mouse holders, made to be attached by adhesive to the side of a monitor, are actually being marketed to avoid sacrificing desk space when the mouse is not in use.) Also, many computers and computer terminals now go into limited work spaces where such installations were not foreseen, resulting in cramped circumstances. To recover this lost desk space, many computer manufacturers took pains to reduce the area occupied by their machines—called in trade jargon the "footprint"—and even advertised the small footprint of their machines compared to the competition.

Yet there has been one neglected area in the search for more space: the top of the monitor. For whatever reasons, computer manufacturers have generally not designed monitors with tray or shelf space on top.

It is not always even possible to use the top of the monitor for storage, for many monitors have ventilation openings on top, so that anything placed there may block the air flow and cause overheating. Also, most monitors do not have level tops, or even uniformly flat tops.

Certain articles of furniture are currently made with the aim of providing shelves beside or above a computer, but these units tend to be expensive and may take up considerable desk area themselves. Hence, many computer users simply make do with available space as best they can. Currently a plastic tray is being marketed to fit on top of a monitor of a specific size and shape. But it will not fit any other, and it does not provide the extra features that will become apparent from the following description of this invention. Also, it is a solid plastic sheet; thus if placed atop a monitor having ventilation holes in the top, it will block these holes.

OBJECTS

Accordingly several objects of this invention are:

to provide a way to recover some or all of the desk space lost to a computer and mouse if used, to provide a way of using the top of a computer monitor for storage space, to provide a tray or shelf adapted to fit atop a computer monitor and hold such items as papers, pens, pencils, rulers, a calculator, adhesive tape, a lamp, a stapler, a scissors, a clock, etc., to make such a tray easily adaptable to most sizes and shapes of monitors, and to provide such a tray in a configuration that will not block any ventilation holes present in the top of a monitor.

Other objects and advantages are:

to provide such a tray in a configuration adapted to stay in place by weight and friction, obviating any need for clamps or adhesive which might damage the paint or the housing of the monitor, to provide such a tray in a configuration easily moved from one monitor to another, to provide such a tray with a means of holding papers conveniently in view of the user, to provide a convenient means of grounding static electricity charges that may accumulate on the body of the user, thus avoiding possible harmful effects on the computer of such charges, and to provide such a product, with these many advantages, that is nonetheless inexpensive and simple to install.

Further objects and advantages will become apparent from the following discussion and drawings.

DRAWING FIGURES

FIG. 1. shows a perspective top view of a computer monitor with a tray in accordance with this invention.

DESCRIPTION

In accordance with the invention, a computer monitor has a tray 10 (FIG. 1) positioned thereon according to a preferred embodiment of the invention. Tray 10 has raised rims 12 at its back and sides. To suit the majority of monitors, tray 10 is typically 35 centimeters wide, 28 centimeters deep, and the rims are 1.5 centimeters high. The material of the tray is sheet metal, preferably steel about 0.5 mm thick.

Figure 2:
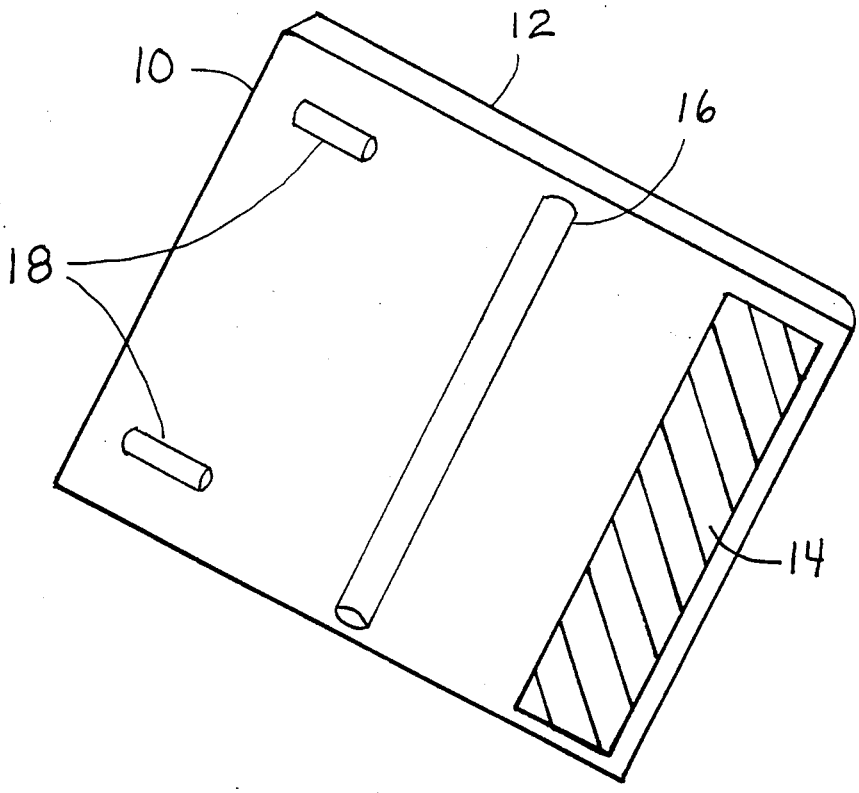
FIG. 2 is a perspective view of the tray from below.

As shown in FIG. 2, the underside of tray 10 has a channel 16 and channels 18, welded to tray 10. Channel 16, oriented in the transverse direction and near the middle of tray 10, has an interior diameter of about 7 mm. Channels 18, with an interior diameter of about 3 mm, are oriented in the longitudinal direction and are each about 5 cm long and extend parallel to each other and longitudinally about 2 cm from the rear of tray 10. Channels 16 and 18 are preferably made of the same sheet metal as tray 10. Also on the underside of tray 10, adjacent to its front edge, is a rubber friction pad 14, about 2 mm thick and having a coefficient of friction of about 0.3 to 0.6.

Figure 3:
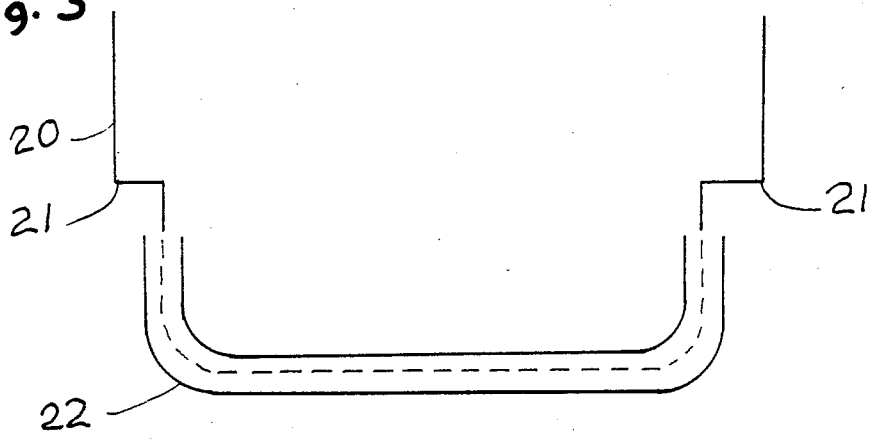
FIG. 3 shows a bendable wire, useful in adjusting the tray to fit a particular monitor.

The tray is supported above the monitor by a bendable wire 20 (FIG. 3), shown in FIG. 3 in the form it has before the user installs it on tray 10. It is preferably of a soft grade of steel, 13 or 14 gauge, similar to coathanger wire. Hence it may be bent by hand to any desired form and will hold that form without springing back. It will, however, be strong enough to resist bending by the weight of tray 10, plus the weight of the items tray 10 will normally hold. A sleeve 22, of a suitable soft plastic, is provided over the center section of wire 20; it prevents wire 20 from scratching the monitor and provides some friction to complement that of friction pad 14. The center section of wire 20 is the "support" section because it will be adjusted to bear upon the rear of the monitor and support the rear of tray 20. Right-angle stop bends 21 are incorporated in wire 20, at a distance from each end equal to the length of channel 18 plus about 5 cm.

Figure 1:
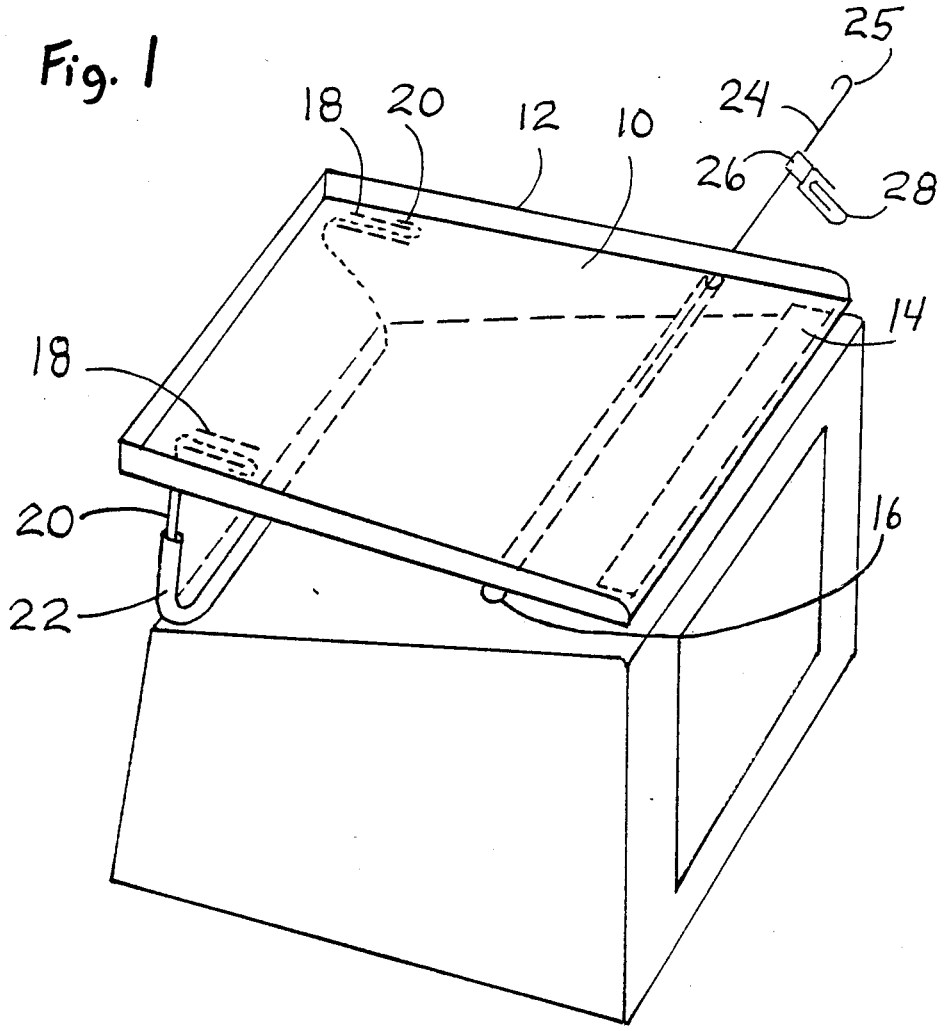
Figure 4:
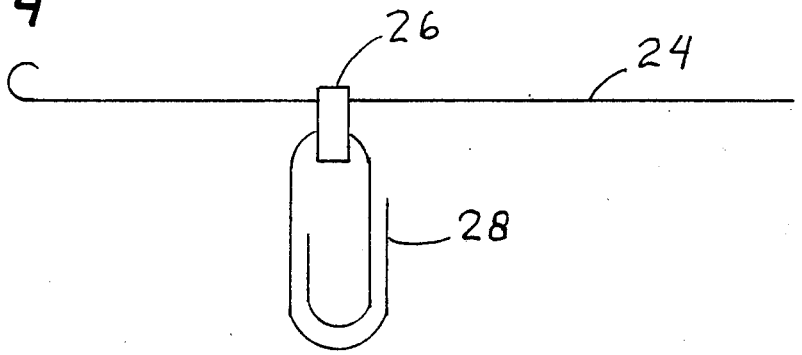
FIG. 4 shows an auxiliary copyholder, useful to hold papers in convenient view of the monitor user.

A copyholder can be attached to the underside of tray 10 to hold papers in convenient view of the user. The copyholder consists of a stiff wire 24 (FIG. 4) or other rigid material, about 25 cm long, which is inserted into channel 16 as shown in FIG. 1. A rubber band 26, about 1.5 cm in diameter, is positioned over wire 24 and carries paper clip 28. Rubber band 26 is slidable on wire 24, and bend 25 at the free end of wire 24 prevents rubber band 26 from accidentally falling off the end.

Figure 5:
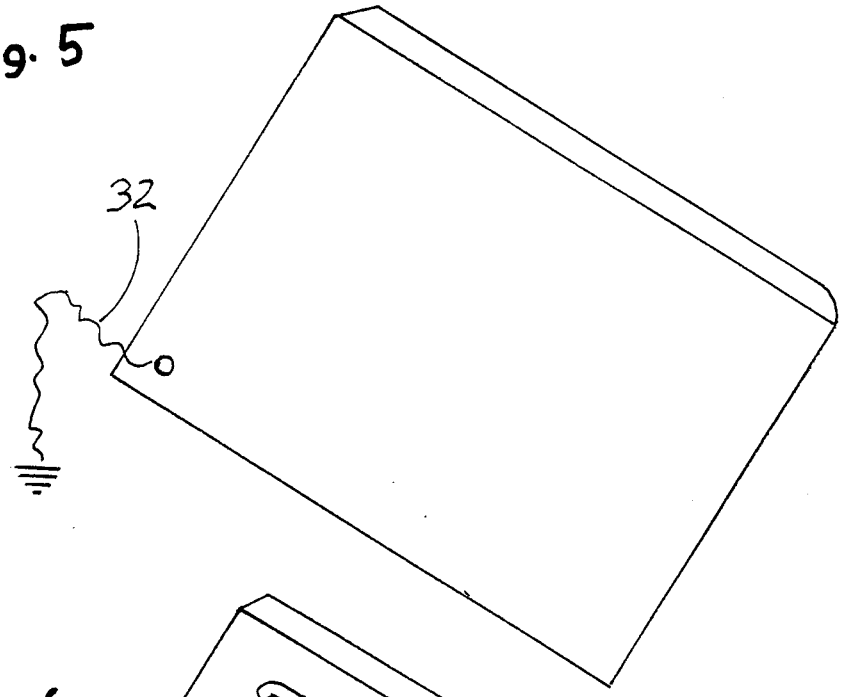
FIG. 5 shows another perspective from below.

Optionally a conductive wire 32 (FIG. 5) may be used to ground tray 10. One end of wire 32 is soldered or welded to tray 10; its other end is connected to a suitable ground as a static electricity drain.

Figure 6:
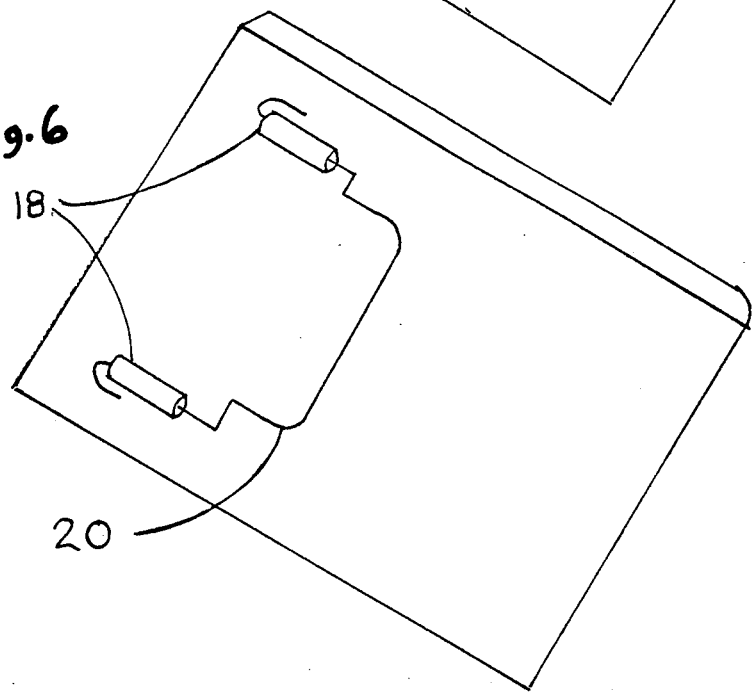
FIG. 6 shows the bendable wire installed on the underside of the tray.

In use, as shown in FIGS. 1 and 6, bendable wire 20 is inserted into channels 18 as far as allowed by right-angle bends 21. The ends of the wire are bent around to clinch the wire 20 into channels 18.

Figure 7:
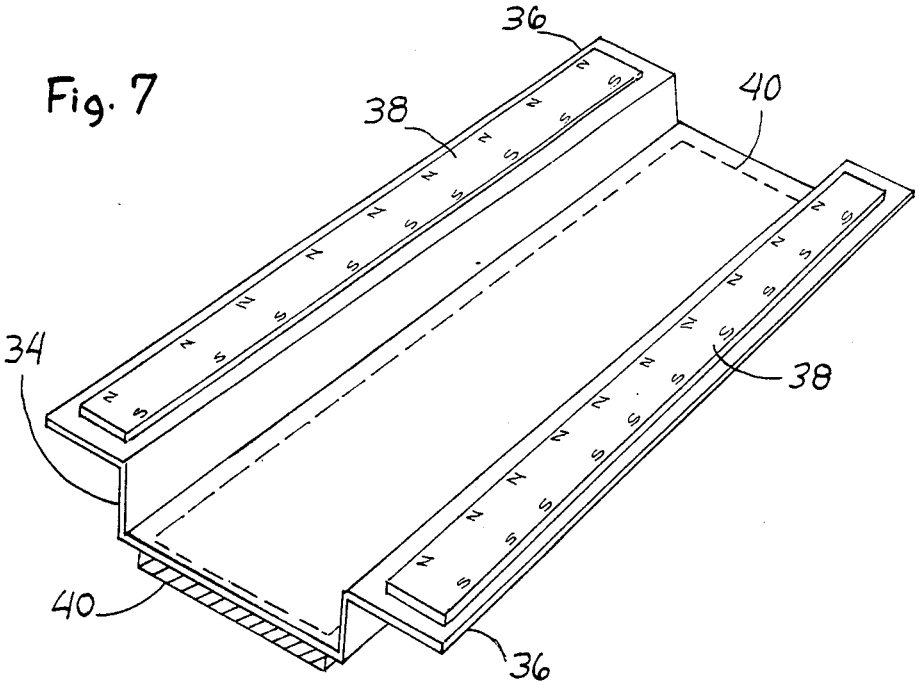
FIG. 7 shows an optional channel member.

In an alternative embodiment, an optional channel 34 (FIGS. 7 and 8), may be substituted for channel 16 and friction surface 14. Channel 34 is made of the same material as tray 10. It has a flattened U-shaped cross section; the ends of the legs have orthogonal flanges 36 to which magnetic strips 38 are attached. Strips 38 are of the well-known flexible or "rubber" magnetic material and have their magnetic poles facing outward, intended to adhere to the underside of tray 10. A layer of rubber or other high-friction material 40 is adhered to the underside of channel 34. Channel 34 is about 5 cm wide and 7 mm deep, of a length not less than half the width of tray 10, and flanges 36 are about 7 mm wide.

Figure 8:
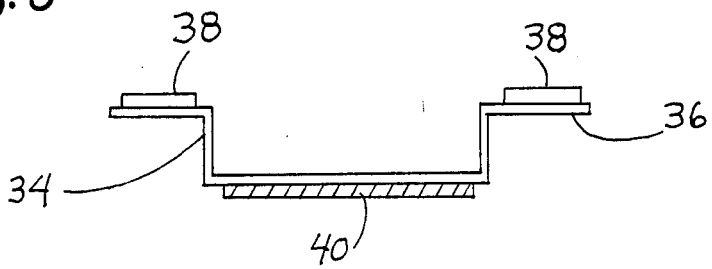
FIG. 8 shows a cross section of the channel member of FIG. 7.

FIG. 8 shows a cross section of channel 34.

Figure 10:
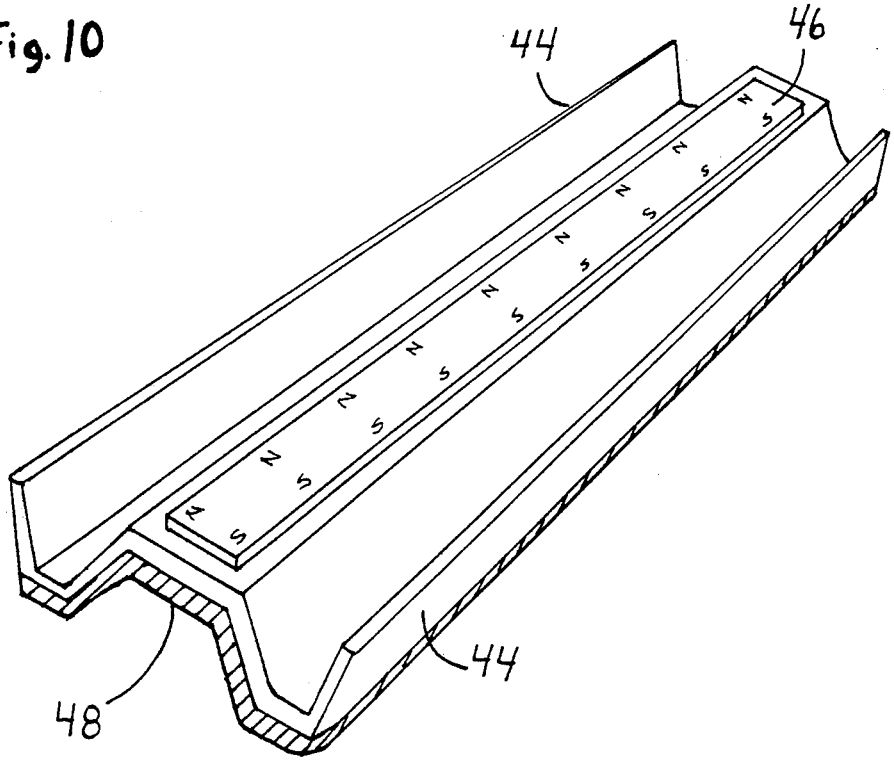
FIG. 10 shows another optional channel member.
Figure 11:
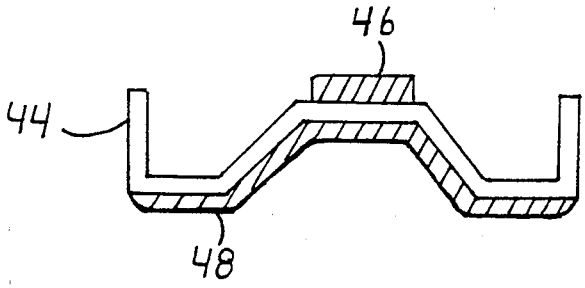
FIG. 11 shows a cross section of the channel member of FIG. 10.

In an alternative embodiment to channel 34, channel 44 (FIGS. 10 and 11) has a flattened W-shaped cross section and about the same dimensions as channel 34. A single magnetic strip 46 is attached to the top of the center of the W, and friction layer 48, similar to 40, is adhered to the underside of channel 44.

OPERATION—FIGS. 1 to 9

Tray 10 of FIG. 1 is installed by first turning it so that the front edge—the edge without raised rim 12—is at the front of the monitor, facing the user. The length—front to back—of tray 10 is then compared with the depth of the monitor.

Figure 9:
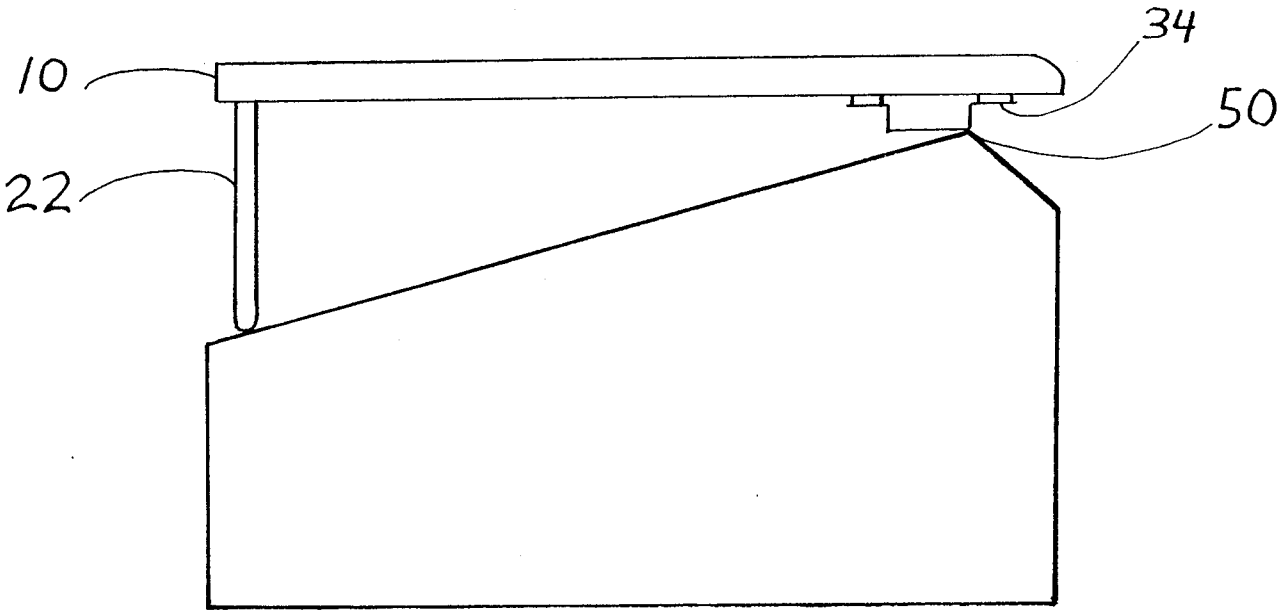
FIG. 9 shows the optional channel of FIGS. 7 and 8 in use.

Based on the comparison between the length of tray 10 and the depth of the monitor, the ends of wire 20 (FIG. 3) are inserted into channels 18 (FIG. 2) from either the front or the rear, whichever better suits the monitor. The ends of wire 20 will pass through channels 18 (see hidden lines in FIG. 1) as far as allowed by bends 21, when the ends of wire 20 will protrude about 5 cm beyond channels 18. These ends are then bent to clinch wire 20 into channels 18. The center section of wire 20 is then bent away from the bottom of tray 10, and adjusted by further bending to fit the rear of the monitor. Then the user places tray 10 atop the monitor so that friction pad 14 rests on the front edge and wire 20 rests on the rear portion, so that wire 20 supports the rear of tray 10. Wire 20 may then be adjusted as necessary to make tray 10 level, or nearly level enough to satisfy the user. (Some users may prefer that tray 10 be inclined towards the front, for better visibility of the items on the tray.) The friction of pad 14 and sleeve 22, held down by the weight of tray 10 plus whatever is placed thereon, then resists any tendency of tray 10 to slip out of position in normal use. Wire 20, maintaining a space between the top of the monitor and the underside of tray 10, assures that any ventilation openings in the top of the monitor are not blocked. Even if the monitor has a flat top, wire 20 plus sleeve 22 will maintain such a space. Channel 34, if used as shown in FIG. 9, will aid in maintaining this space.

Next the user inserts copyholder 24 into channel 16 from whichever side of the monitor is convenient. Of course a second copyholder 24 may be inserted into the other side if desired.

It is well known that static electricity is a hazard to computers; such static usually being accumulated in dry weather on the body of the computer user while walking on a carpet, for example. The user's first touch on the computer may allow the static charge to go to ground via its circuits. This can erase the working memory of the computer and cause physical damage.

Hence wire 32, which may be connected to a suitable nearby ground, is provided to ground such charges. Thus, before touching the keyboard or other part of the computer, the user can touch the front edge of tray 10, which may purposely be left bare. Any possible static charge will go to ground via the tray, without risk to the computer. Optionally the front edge of tray 10 may be covered with a semi-conductive strip (not shown) so that the user can touch this and have any bodily static charges grounded at a lower current flow so as not to receive a shock.

Optionally, channel 34 (FIGS. 7 & 8) may be substituted for both channel 16 and friction surface 14. The user simply need attach channel 34 to the underside of tray 10 near its front, by means of magnetic strips 38. Friction surface 40 then serves in place of friction surface 14, and copyholder 24 may be inserted into channel 34. Since Channel 34 is attached by magnetism, its position is adjustable, whereas channel 16 and friction pad 14 are fixed. Thus this version would be even easier to adapt to different monitors. FIG. 9 shows a tray 10 on a monitor top, using channel 34, which rests on edge 50 at the front of the monitor. Optionally, channel 44 may be substituted for channel 34.

SUMMARY, RAMIFICATIONS, SCOPE

To summarize, the tray of my invention recovers some or all of the desk space that is lost when an office worker acquires a computer, by using the top of the monitor. It provides a convenient copyholder, thus making extra use of the monitor. It provides a convenient means of grounding static electricity which may accumulate on the body of the user and possibly harm the computer. It is simple to install and adapt to most monitors. If the user changes to a different size or shape monitor, it is easily moved to the new one, for it uses no clamps, fasteners, or adhesive. For the same reason, it will not damage or deface the monitor. And when correctly installed it will not block any ventilation openings in the top of the monitor.

While the above description contains many specificities, these should not be construed as limitations on the scope of the invention, but rather as an exemplification of one preferred embodiment thereof. Many other variations are possible. For example tray 10 may be of plastic, so that friction pad 14 can be replaced by a molded-in friction surface; indeed the entire tray bottom may be a friction surface. The coefficient of friction of pad 14, or the bottom surface of tray 10, should be at least 0.3 to resist slipping in normal use. Tray 10 may be made of an electrically conductive plastic, or coated with such plastic, to aid in the static discharge function. An optional second tray may be provided, adapted to fit atop tray 10. Conductive wire 32 need not be welded or soldered to tray 10; it may simply be attached to a bare portion of wire 20. Tray 10 may have a trapezoid form instead of a rectangle. Rims 12 may be omitted. A wood or plastic rod may be used instead of wire 24. Instead of U-shaped channel 34 or W-shaped channel 44 there may be a flat strip incorporating a groove for wire 24. Accordingly, the scope of the invention should be determined not by the embodiment illustrated, but by the appended claims and their legal equivalents.

I claim:

1. A tray for placement atop a computer monitor for holding items in the space above said monitor without allowing such items to fall or block the air vents in the top of such monitor, comprising:

a tray having a flat upper surface and means for causing objects placed in said tray to resist falling off a plurality of sides of said tray, means associated with the undersurface of said tray for enabling said tray to be placed on top of any computer monitor within a range of sizes and shapes without falling off said monitor and without blocking any air vents on the top of said monitor, said means comprising a friction surface at the front of said undersurface of said tray and an adjustable wire support at the rear of said undersurface of said tray.

2. The tray of claim 1 wherein said friction surface has a coefficient of friction greater than about 0.3 and said adjustable wire support comprises wire-holding means and a bendable length of wire attached to said wire-holding means, said wire extending generally normal to said lower surface of said tray, said wire-holding means and said wire being arranged so that said wire can be bent and positioned so that one portion of said wire can be positioned on a rear surface of the top of said monitor and another portion of said wire will support said opposite end of said tray a given distance above said monitor when said tray is placed thereon, and so that said wire can be used to support said tray on monitors of a given range of sizes.

3. The tray assembly of claim 2 wherein said wire-holding means comprises a plurality of tubular channels attached to said lower surface of said tray.

4. The tray assembly of claim 3 wherein said plurality of tubular channels are mounted in parallel at spaced locations adjacent one end of said lower surface.

5. A tray assembly for placement atop a computer monitor, comprising:

a tray comprising a flat member having upper and lower major surfaces which face in opposite directions, an area of one side of said lower surface having friction means which has a coefficient of friction greater than about 0.3, the opposite side of said lower surface having wire-holding means attached thereto, a bendable length of wire being attached to said wire-holding means, one portion of said wire extending generally normal to said lower surface of said tray, said wire-holding means and said wire being arranged so that said wire can be bent and positioned so that one portion of said wire can be positioned on a rear surface of the top of said monitor and another portion of said wire will support said opposite side of said lower surface of said tray a give distance above said monitor when said tray is placed thereon, and so that said wire can be used to support said tray on monitors of a given range of sizes.

6. The tray assembly of claim 5 wherein said friction means comprises a layer of rubber which is adhesively secured to said area of said lower surface of said tray.

7. The tray assembly of claim 5 wherein said tray is made of sheet metal.

8. The tray assembly of claim 5 wherein said wire holding means comprises a plurality of tubular channels attached to said lower surface of said tray.

9. The tray assembly of claim 8 wherein said plurality of tubular channels attached to said lower surface of said tray are mounted in parallel at spaced locations adjacent one end of said lower surface.

10. The tray assembly of claim 8 wherein said bendable length of wire comprises a length of wire which has a pair of stop means at spaced locations thereon, a pair of spacer sections adjacent said respective stop means, and a center support section between said spacer sections, said center section being joined to said spacer sections by a pair of bends, and said spacer sections being joined to said stop means by a pair of bends.

11. The tray assembly of claim 5 wherein said tray has a plurality of upright sides on at least three edges thereof, said sides being perpendicular to said upper surface.

12. The tray assembly of claim 5, further including a copyholder attached to said lower surface of said tray, said copyholder comprising suspension means for suspending at least one sheet of paper from said lower surface so that said paper is normal to said lower surface.

13. The tray assembly of claim 12 wherein said suspension means comprises additional wire-holding means attached to lower surface of said tray, an elongated rod inserted into said additional wire-holding means, and paper-holding means mounted on said rod.

14. The tray assembly of claim 13 wherein said additional wire-holding means comprises a hollow channel attached to lower surface of said tray.

15. The tray assembly of claim 14 wherein said hollow channel attached to said lower surface of said tray extends across at least half of said entire lower surface of said tray.

16. The tray assembly of claim 5, further including static electricity grounding means attached to said tray.

17. The tray assembly of claim 5 wherein said friction means comprises a member having an upper surface containing magnetic attachment means and a lower surface facing in a direction opposite to that of said upper surface and comprising said friction means.

18. The tray assembly of claim 17 wherein said member is a channel having a U-shaped configuration with a central section and has orthogonal legs at the opposite ends of said central section having a pair of flanged sections respectively attached thereto, said flange sections being parallel to said center section, one side of said center section having said friction means attached thereto, one side of each of said flange sections, opposite said one side of said center section, having said magnetic attachment means attached thereto.

19. The tray assembly of claim 18 wherein said friction means is a sheet of material selected from the group consisting of plastic or rubber, and said magnetic attachment means is a resilient sheet of magnetic material.

20. The tray assembly of claim 17 wherein said member is a channel having a W-shaped configuration, having said magnetic means attached atop the center portion of the W.

* * * * *